US008027835B2

(12) United States Patent
Aizawa

(10) Patent No.: US 8,027,835 B2
(45) Date of Patent: Sep. 27, 2011

(54) SPEECH PROCESSING APPARATUS HAVING A SPEECH SYNTHESIS UNIT THAT PERFORMS SPEECH SYNTHESIS WHILE SELECTIVELY CHANGING RECORDED-SPEECH-PLAYBACK AND TEXT-TO-SPEECH AND METHOD

(75) Inventor: Michio Aizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 639 days.

(21) Appl. No.: 12/170,124

(22) Filed: Jul. 9, 2008

(65) Prior Publication Data

US 2009/0018837 A1 Jan. 15, 2009

(30) Foreign Application Priority Data

Jul. 11, 2007 (JP) ..... 2007-182555
May 22, 2008 (JP) ..... 2008-134655

(51) Int. Cl.
*G10L 13/00* (2006.01)

(52) U.S. Cl. ..... 704/258; 704/260; 704/270

(58) Field of Classification Search ..... 704/260, 704/258, 273, 274
See application file for complete search history.

(56) References Cited

U.S. PATENT DOCUMENTS 6,029,132 A * 2/2000 Kuhn et al. ..... 704/260
6,175,821 B1 * 1/2001 Page et al. ..... 704/258
6,345,250 B1 * 2/2002 Martin ..... 704/260
6,697,780 B1 * 2/2004 Beutnagel et al. ..... 704/258
6,725,199 B2 * 4/2004 Brittan et al. ..... 704/258
6,988,069 B2 * 1/2006 Phillips ..... 704/258
7,031,438 B1 * 4/2006 Cheston et al. ..... 379/88.14
7,043,435 B2 * 5/2006 Knott et al. ..... 704/270
7,050,560 B2 * 5/2006 Martin et al. ..... 379/218.01
7,062,439 B2 * 6/2006 Brittan et al. ..... 704/260

(Continued)

FOREIGN PATENT DOCUMENTS

JP 09-097094 4/1997

(Continued)

OTHER PUBLICATIONS

Alexander Rudnicky, et al., "Task and Domain Specific Modelling in the Carnegie Mellon Communicator System," In Proceedings of the International Conference of Spoken Language Processing, Beijing, China, 2000.*

(Continued)

*Primary Examiner* — James S. Wozniak
*Assistant Examiner* — Fariba Sirjani
(74) *Attorney, Agent, or Firm* — Fitzpatrick, Cella, Harper & Scinto

(57) ABSTRACT

A speech processing apparatus which can playback a sentence using recorded-speech-playback or text-to-speech is provided. It is determined whether each of a plurality of words or phrases constituting a sentence is a word or phrase to be played back by recorded-speech-playback or a word or phrase to be played back by text-to-speech. When each of the plurality of words or phrases is to be played back in a first sequence using the determined synthesis method, it is selected whether to playback each of the plurality of words or phrases in the first sequence or a sequence different from the first sequence, based on the number of times of reversing playback using recorded-speech-playback and playback using text-to-speech. Each of the plurality of words or phrases is played back in the selected sequence using the selected synthesis method.

4 Claims, 15 Drawing Sheets

U.S. PATENT DOCUMENTS

| | | | | |
|---|---|---|---|---|
| 7,082,396 | B1 * | 7/2006 | Beutnagel et al. | 704/258 |
| 7,136,462 | B2 * | 11/2006 | Pelaez et al. | 379/88.14 |
| 7,165,030 | B2 * | 1/2007 | Yi et al. | 704/238 |
| 7,191,132 | B2 * | 3/2007 | Brittan et al. | 704/260 |
| 7,349,846 | B2 | 3/2008 | Aizawa | 704/260 |
| 7,580,839 | B2 * | 8/2009 | Tamura et al. | 704/258 |
| 7,630,896 | B2 * | 12/2009 | Tamura et al. | 704/258 |
| 2002/0065659 | A1 * | 5/2002 | Isono et al. | 704/260 |
| 2002/0072908 | A1 * | 6/2002 | Case et al. | 704/260 |
| 2003/0074196 | A1 * | 4/2003 | Kamanaka | 704/260 |
| 2003/0177010 | A1 * | 9/2003 | Locke | 704/260 |
| 2003/0187651 | A1 * | 10/2003 | Imatake | 704/269 |
| 2003/0229496 | A1 * | 12/2003 | Yamada et al. | 704/258 |
| 2004/0006476 | A1 * | 1/2004 | Chiu | 704/270.1 |
| 2004/0015344 | A1 * | 1/2004 | Shimomura et al. | 704/200 |
| 2004/0225499 | A1 * | 11/2004 | Wang et al. | 704/257 |
| 2005/0137870 | A1 * | 6/2005 | Mizutani et al. | 704/264 |
| 2005/0182629 | A1 * | 8/2005 | Coorman et al. | 704/266 |
| 2006/0074677 | A1 * | 4/2006 | DeSimone | 704/261 |
| 2008/0177548 | A1 * | 7/2008 | Yamada et al. | 704/260 |
| 2008/0228487 | A1 * | 9/2008 | Okutani et al. | 704/268 |
| 2008/0312929 | A1 * | 12/2008 | Blass et al. | 704/260 |

FOREIGN PATENT DOCUMENTS

WO WO 2006/129814 A1 12/2006

OTHER PUBLICATIONS

J. Yi and J. Glass, "Natural-Sounding Speech Synthesis Using Variable-Length Units," Proc. ICSLP, Sydney, Australia, Nov. 1998.*

* cited by examiner

FIG. 4

| SPELLING | PRONUNCIATION | SPEECH | TELEPHONE NUMBER | FAX | E-mail |
|---|---|---|---|---|---|
| SATO | SATO | w2001 | 111-1111 | 111-1112 | satoh@aaa.com |
| SUZUKI | | | 222-1111 | 222-1112 | suzuki@bbb.com |
| TANAKA | TANAKA | | 333-1111 | 333-1112 | tanaka@ccc.com |
| Boyle | | w2002 | 444-1111 | 444-1112 | boyle@ccc.com |
| Smith | SUMISU | w2003 | 555-1111 | 555-1112 | smith@eee.com |
| . . | . . | . . | . . | . . | . . |

FIG. 5

| ID | GUIDANCE 1 | GUIDANCE 2 |
|---|---|---|
| 1 | START SENDING TO <$name> BY FAX. | START SENDING BY FAX. DESTINATION IS, <$name>. |
| 2 | SCAN TO SEND TO <$name> BY E-MAIL. | SCAN TO SEND BY E-MAIL. DESTINATION IS, <$name>. |
| . . | . . . . | . . . . |

FIG. 6

| SPELLING | SPEECH |
|---|---|
| START SENDING | w1001 |
| TO | w1002 |
| BY FAX | w1003 |
| DESTINATION IS | w1004 |
| SCAN TO SEND | w1005 |
| BY E-MAIL | w1006 |
| , | w1007 |
| . | w1008 |
| TITILE IS | w1009 |
| . . . . | . . . . |

FIG. 7

| MORA | SPEECH |
|---|---|
| A | w0226 |
| I | w0223 |
| U | w0221 |
| E | w0215 |
| O | w0213 |
| KA | w0212 |
| .... | .... |
| SU | w0165 |
| .... | .... |

FIG. 8

| ID | BASIC SYNTHESIS UNIT |
|---|---|
| 1 | START SENDING |
| 2 | BY FAX |
| 3 | . |
| 4 | DESTINATION IS |
| 5 | , |
| 6 | <PRONUNCIATION=TANAKA;> |
| 7 | . |

FIG. 9

| ID | TAG |
|---|---|
| 1 | <SPELLING=START SENDING; SPEECH=w1001;> |
| 2 | <SPELLING=BY FAX; SPEECH=w1003;> |
| 3 | <SPELLING=.; SPEECH=w1008;> |
| 4 | <SPELLING=DESTINATION IS; SPEECH=w1004;> |
| 5 | <SPELLING=,; SPEECH=w1007;> |
| 6 | <PRONUNCIATION=TANAKA ; > |
| 7 | <SPELLING=.; SPEECH=w1008;> |

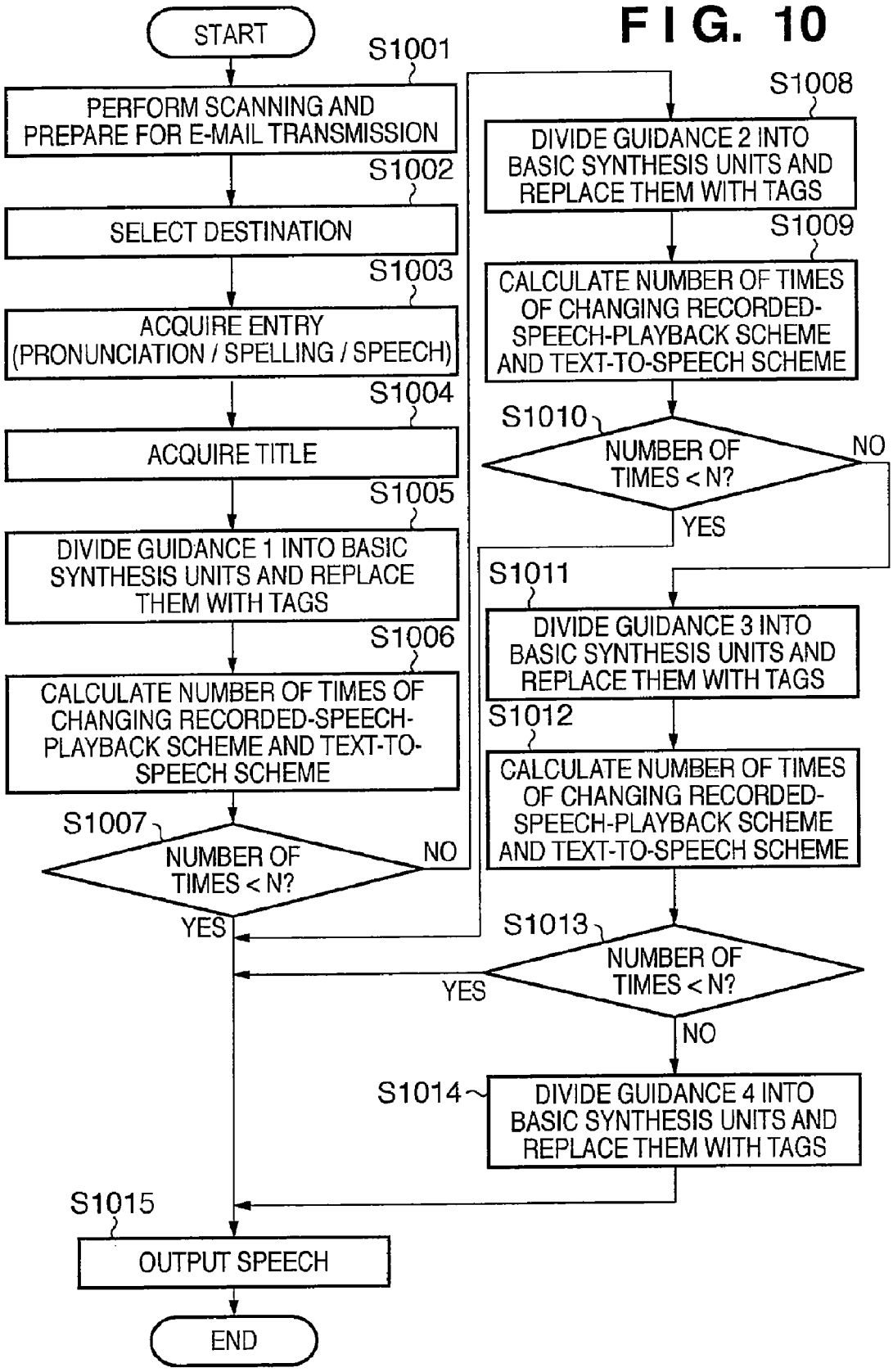
FIG. 10
START
S1001
PERFORM SCANNING AND PREPARE FOR E-MAIL TRANSMISSION
S1002
SELECT DESTINATION
S1003
ACQUIRE ENTRY (PRONUNCIATION / SPELLING / SPEECH)
S1004
ACQUIRE TITLE
S1005
DIVIDE GUIDANCE 1 INTO BASIC SYNTHESIS UNITS AND REPLACE THEM WITH TAGS
S1006
CALCULATE NUMBER OF TIMES OF CHANGING RECORDED-SPEECH-PLAYBACK SCHEME AND TEXT-TO-SPEECH SCHEME
S1007
NUMBER OF TIMES < N?
NO
YES
S1008
DIVIDE GUIDANCE 2 INTO BASIC SYNTHESIS UNITS AND REPLACE THEM WITH TAGS
S1009
CALCULATE NUMBER OF TIMES OF CHANGING RECORDED-SPEECH-PLAYBACK SCHEME AND TEXT-TO-SPEECH SCHEME
S1010
NUMBER OF TIMES < N?
NO
YES
S1011
DIVIDE GUIDANCE 3 INTO BASIC SYNTHESIS UNITS AND REPLACE THEM WITH TAGS
S1012
CALCULATE NUMBER OF TIMES OF CHANGING RECORDED-SPEECH-PLAYBACK SCHEME AND TEXT-TO-SPEECH SCHEME
S1013
NUMBER OF TIMES < N?
YES
NO
S1014
DIVIDE GUIDANCE 4 INTO BASIC SYNTHESIS UNITS AND REPLACE THEM WITH TAGS
S1015
OUTPUT SPEECH
END

FIG. 11

| ID | GUIDANCE 1 | GUIDANCE 2 | GUIDANCE 3 | GUIDANCE 4 |
|---|---|---|---|---|
| 1 | SCAN TO SEND <$title> TO <$name> BY E-MAIL. | SCAN TO SEND <$title> BY E-MAIL. DESTINATION IS, <$name>. | SCAN TO SEND TO <$name> BY E-MAIL. TITLE IS, <$TITLE>. | SCAN TO SEND BY E-MAIL. DESTINATION IS, <$name>. TITLE IS, <$title>. |
| . . | . . . . | . . . . | . . . . | . . . . |

FIG. 12

| ID | TAG |
|---|---|
| 1 | <SPELLING=SCAN TO SEND; SPEECH=w1005;> |
| 2 | <SPELLING=WEEKLY REPORT;> |
| 3 | <SPELLING=TO; SPEECH=w1002;> |
| 4 | <SPEECH=w2001;> |
| 5 | <SPELLING=BY E-MAIL; SPEECH=w1006;> |
| 6 | <SPELLING=.; SPEECH=w1008;> |

FIG. 13

| ID | TAG |
|---|---|
| 1 | <SPELLING=SCAN TO SEND; SPEECH=w1005;> |
| 2 | <SPELLING=WEEKLY REPORT;> |
| 3 | <SPELLING=BY E-MAIL; SPEECH=w1006;> |
| 4 | <SPELLING=.; SPEECH=w1008;> |
| 5 | <SPELLING=DESTINATION IS; SPEECH=w1004> |
| 6 | <SPELLING=,; SPEECH=w1007> |
| 7 | <SPEECH=w2001;> |
| 8 | <SPELLING=.; SPEECH=w1008;> |

FIG. 14

| ID | TAG |
|---|---|
| 1 | <SPELLING=SCAN TO SEND; SPEECH=w1005;> |
| 2 | <SPELLING=TO; SPEECH=w1002> |
| 3 | <SPEECH=w2001;> |
| 4 | <SPELLING=BY E-MAIL; SPEECH=w1006;> |
| 5 | <SPELLING=.; SPEECH=w1008;> |
| 6 | <SPELLING=TITLE IS; SPEECH=w1009> |
| 7 | <SPELLING=,; SPEECH=w1007> |
| 8 | <SPELLING=WEEKLY REPORT;> |
| 9 | <SPELLING=.; SPEECH=w1008;> |

SPEECH PROCESSING APPARATUS HAVING A SPEECH SYNTHESIS UNIT THAT PERFORMS SPEECH SYNTHESIS WHILE SELECTIVELY CHANGING RECORDED-SPEECH-PLAYBACK AND TEXT-TO-SPEECH AND METHOD

BACKGROUND OF THE INVENTION

1. Field of the Invention

The present invention relates to a speech processing apparatus and method.

2. Description of the Related Art

Speech synthesis methods include a recorded-speech-playback method and a text-to-speech method. Recorded-speech-playback synthesizes speech by connecting recorded words and phrases. Recorded-speech-playback provides high speech quality but can only be used for repetitive sentences. Text-to-speech analyzes an input sentence and converts it into speech. This technique may receive pronunciations and phonetic symbols instead of sentences. Text-to-speech can be used for all kinds of sentences but is inferior in speech quality to recorded-speech-playback and is not free from reading errors.

Conventionally, some speech processing apparatus designed to output guidance speech by speech synthesis uses a method using both recorded-speech-playback and text-to-speech (Japanese Patent Laid-Open No. 9-97094).

According to the above conventional technique, however, frequently changing recorded-speech-playback and text-to-speech in one piece of guidance speech will make it difficult to hear the guidance due to the difference in speech quality between the two techniques.

SUMMARY OF THE INVENTION

It is an object of the present invention to improve the perceptual naturality of speech synthesis in a speech processing apparatus which performs speech synthesis while changing recorded-speech-playback and text-to-speech.

According to one aspect of the present invention, a speech processing apparatus which is configured to playback a sentence including a plurality of words or phrases using recorded-speech-playback or text-to-speech as a speech synthesis method is provided. The apparatus comprises a determining unit configured to determine whether each of a plurality of words or phrases constituting a sentence is a word or phrase to be played back by recorded-speech-playback or a word or phrase to be played back by text-to-speech, a selection unit configured to select whether to playback each of the plurality of words or phrases in a first sequence or a sequence different from the first sequence, based on the number of times of reversing playback using recorded-speech-playback and playback using text-to-speech, when each of the plurality of words or phrases is to be played back in the first sequence using a synthesis method specified by the determining unit, and a playback unit configured to playback each of the plurality of words or phrases in a sequence selected by the selection unit using a synthesis method specified by the determining unit.

Further features of the present invention will become apparent from the following description of exemplary embodiments with reference to the attached drawings.

BRIEF DESCRIPTION OF THE DRAWINGS

FIG. 4 is a view showing an example of the structure of an address book held by an entry holding unit in the embodiment;

FIG. 5 is a view showing an example of guidance information held by a guidance holding unit in the embodiment;

FIG. 6 is a view showing an example of a basic synthesis unit dictionary in the embodiment;

FIG. 7 is a view showing an example of a low-level synthesis unit dictionary in the embodiment;

FIG. 8 is a view showing an example of the division of guidance into basic synthesis units in the embodiment;

FIG. 9 is a view showing an example of the replacement of divided basic synthesis units with tags in the embodiment;

FIG. 10 is a flowchart for explaining an example of the operation of the speech processing apparatus in the embodiment;

FIG. 11 is a view showing an example of guidance information held by the guidance holding unit in the embodiment;

FIG. 12 is a view showing an example of the replacement of divided basic synthesis units with tags in the embodiment;

FIG. 13 is a view showing an example of the replacement of divided basic synthesis units with tags in the embodiment; and FIG. 14 is a view showing an example of the replacement of divided basic synthesis units with tags in the embodiment.

DESCRIPTION OF THE EMBODIMENTS

Preferred embodiments of the present invention will be described in detail in accordance with the accompanying drawings. The present invention is not limited by the disclosure of the embodiments and all combinations of the features described in the embodiments are not always indispensable to solving means of the present invention.

The following embodiment exemplifies a case in which the present invention is applied to an image forming apparatus having a FAX function.

Figure 1A:
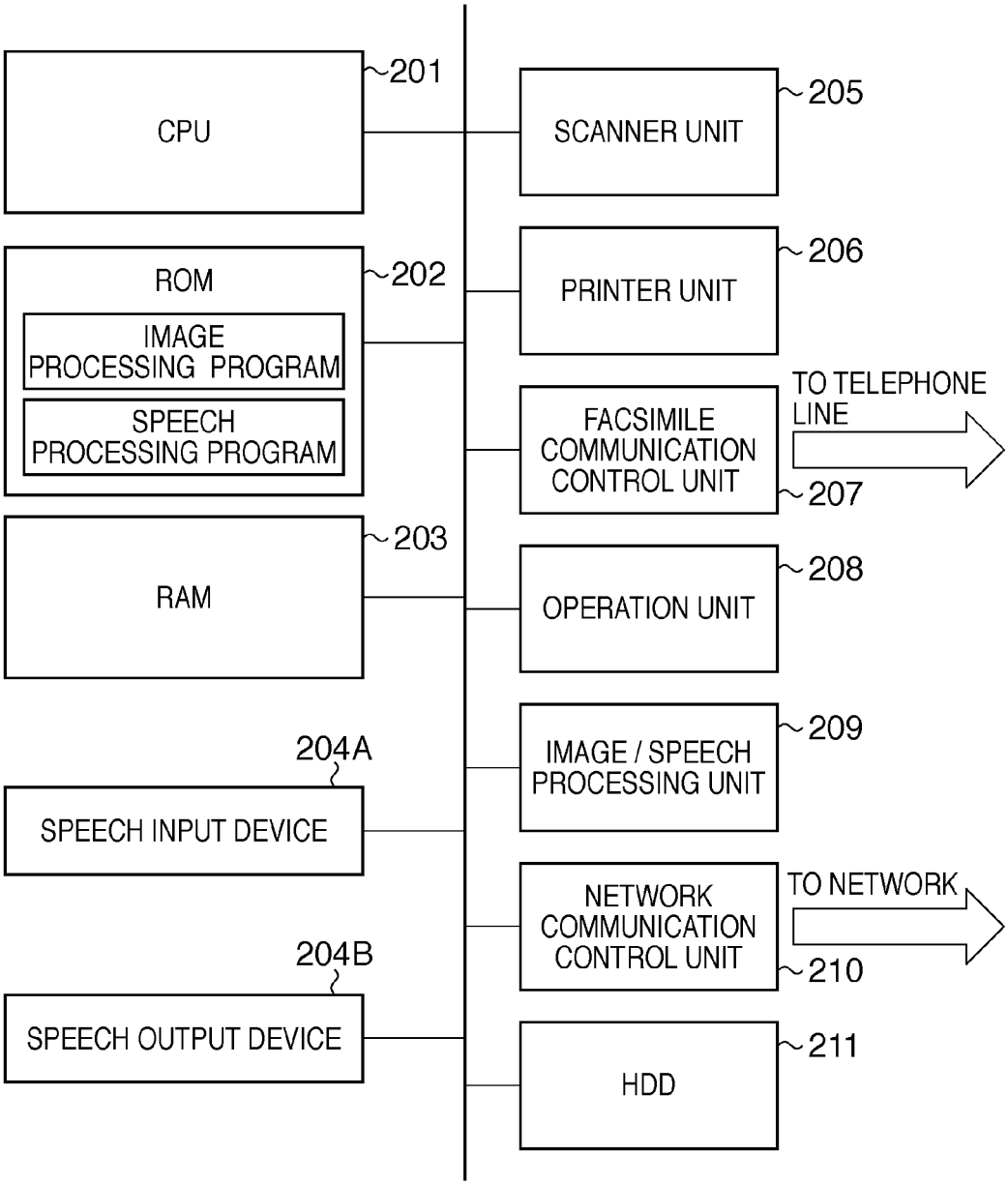
FIG. 1A is a block diagram showing an example of the hardware arrangement of an image forming apparatus according to an embodiment.

FIG. 1A is a block diagram showing an outline of the hardware arrangement of an image forming apparatus to which a speech processing apparatus of the present invention is applied.

Reference numeral 201 denotes a CPU (Central Processing Unit), which serves as a system control unit and controls the overall operation of the apparatus; and 202, a ROM which stores control programs. More specifically, the ROM 202 stores a speech processing program for performing speech processing to be described later and an image processing program for encoding images. Reference numeral 203 denotes a RAM which provides a work area for the CPU 201 and is used to store various kinds of data and the like.

Reference numeral 204A denotes a speech input device such as a microphone; and 204B, a speech output device such as a loudspeaker.

Reference numeral 205 denotes a scanner unit which is a device having a function of reading image data and converting it into binary data; and 206, a printer unit which has a printer function of outputting image data onto a recording sheet.

Reference numeral 207 denotes a facsimile communication control unit which is an interface for performing facsimile communication with a remotely placed facsimile apparatus via an external line such as a telephone line; and 208, an operation unit to be operated by an operator. More specifically, the operation unit 208 includes operation buttons such as a ten-key pad, a touch panel, and the like.

Reference numeral 209 denotes an image/speech processing unit. More specifically, the image/speech processing unit 209 comprises a hardware chip such as a DSP and executes product-sum operation and the like in image processing and speech processing at high speed.

Reference numeral 210 denotes a network communication control unit which has a function of interfacing with a network line and is used to receive a print job or execute Internet FAX transmission/reception; and 211, a hard disk drive (HDD) 211 which holds an address book, speech data, and the like (to be described later).

Figure 1B:
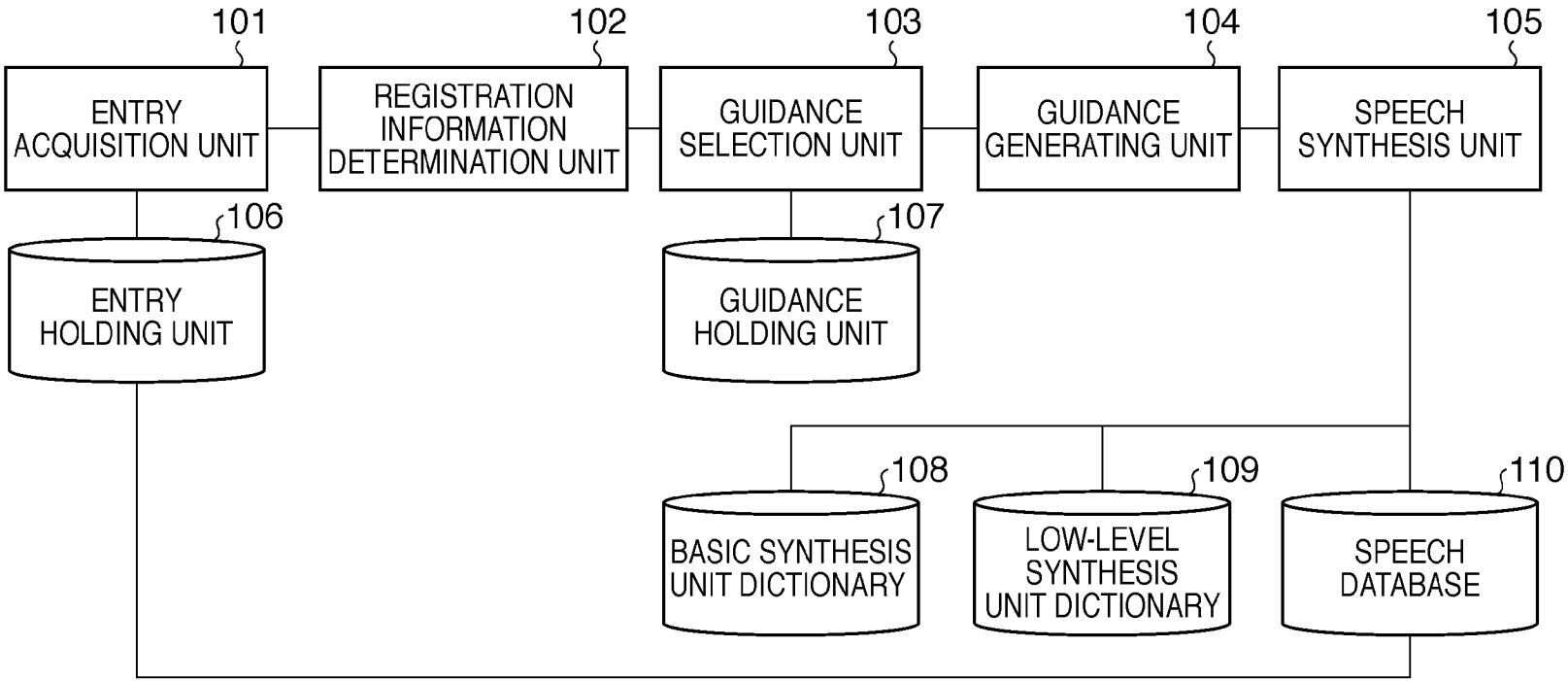
FIG. 1B is a block diagram showing the functional arrangement of a speech processing apparatus in the embodiment.

FIG. 1B is a block diagram showing the functional arrangement of the speech processing apparatus implemented by the above image forming apparatus.

An entry acquisition unit 101 acquires an entry on which at least a spelling, its pronunciation and its speech can be registered. An entry holding unit 106 formed in the HDD 211 holds entries (words or phrases).

The entry holding unit 106 holds, for example, a set of entries constituting an address book having a data structure like that shown in FIG. 4. Each entry allows registration of a spelling, its pronunciation, speech corresponding to the pronunciation, a telephone number, a FAX number, and an E-mail address which are associated with user operation.

The speech registered in an entry is that obtained by vocalizing the content of the entry and recording it via the speech input device 204A. Symbols w2001 and w2002 and the like in the column of "speech" in FIG. 4 are speech indexes for extracting speech.

A registration information determination unit 102 determines whether any speech is registered in the entry acquired by the entry acquisition unit 101.

A guidance selection unit 103 selects one piece of guidance held by a guidance holding unit 107 formed in the HDD 211 in accordance with the entry acquired by the entry acquisition unit 101. If speech is registered in the entry, the guidance selection unit 103 selects guidance 1 (to be described later). If no speech is registered in the entry, the guidance selection unit 103 selects guidance 2 (to be described later). The guidance holding unit 107 manages the pieces of guidance using IDs. The guidance holding unit 107 holds guidance 1 (first guidance) and guidance 2 (second guidance) for each ID. Each piece of guidance contains a variable portion indicating that a message corresponding to user operation is inserted, in addition to fixed portions in which the contents of messages are fixed.

FIG. 5 shows an example of the pieces of guidance held by the guidance holding unit 107. In each guidance, the portion <$name> is a variable portion, and the remaining portions are fixed portions. Each guidance with ID "1" is used to check the destination of FAX transmission upon selection of the FAX function. Each guidance with ID "2" is used to check the destination of mail upon selection of the mail function.

As shown in FIG. 5, guidance 1 and guidance 2 represent synonymous contents but use different expressions. That is, the two pieces of guidance differ in the sequence of words or phrases. More specifically, guidance 1 has the fixed portions "START SENDING TO" and "BY FAX.". A variable portion is located between them. On the other hand, guidance 2 has the variable portion of guidance 1 located after the end of a fixed portion. In this case, a word or phrase which explains the variable portion is located immediately before the variable portion. In the case shown in FIG. 5, the phrase "DESTINATION IS," is located immediately before the variable portion.

A guidance generating unit 104 inserts the information of the entry acquired by the entry acquisition unit 101 in the guidance selected by the guidance selection unit 103 and finally generates a guidance to be output.

A speech synthesis unit 105 can perform speech synthesis while selectively changing recorded-speech-playback and text-to-speech, and generates the synthetic speech of the guidance generated by the guidance generating unit 104 via the speech output device 204B. More specifically, recorded-speech-playback is used for the fixed portions in guidance and an entry portion in which speech is registered. Text-to-speech is used for an entry portion (a word or phrase) in which no speech is registered.

A basic synthesis unit dictionary 108 formed in the HDD 211 holds information associated with words or phrases contained in the fixed portions of guidance. The basic synthesis unit dictionary 108 also holds speech indexes for extracting at least spellings and corresponding pieces of speech. FIG. 6 shows an example of such information. Assume that a speech index w1007 corresponding to the comma "," indicates a silence of 300 ms, and that a speech index w1008 corresponding to the period "." indicates a silence of 400 ms.

A low-level synthesis unit dictionary 109 formed in the HDD 211 holds speech indexes required for text-to-speech. The unit of speech to be used is, for example, a phoneme, diphone, or mora. FIG. 7 shows an example of the low-level synthesis unit dictionary 109 on a mora basis.

A speech database 110 formed in the HDD 211 collectively holds pieces of speech corresponding to the speech indexes held by the entry holding unit 106, basic synthesis unit dictionary 108, and low-level synthesis unit dictionary 109.

Figure 2:
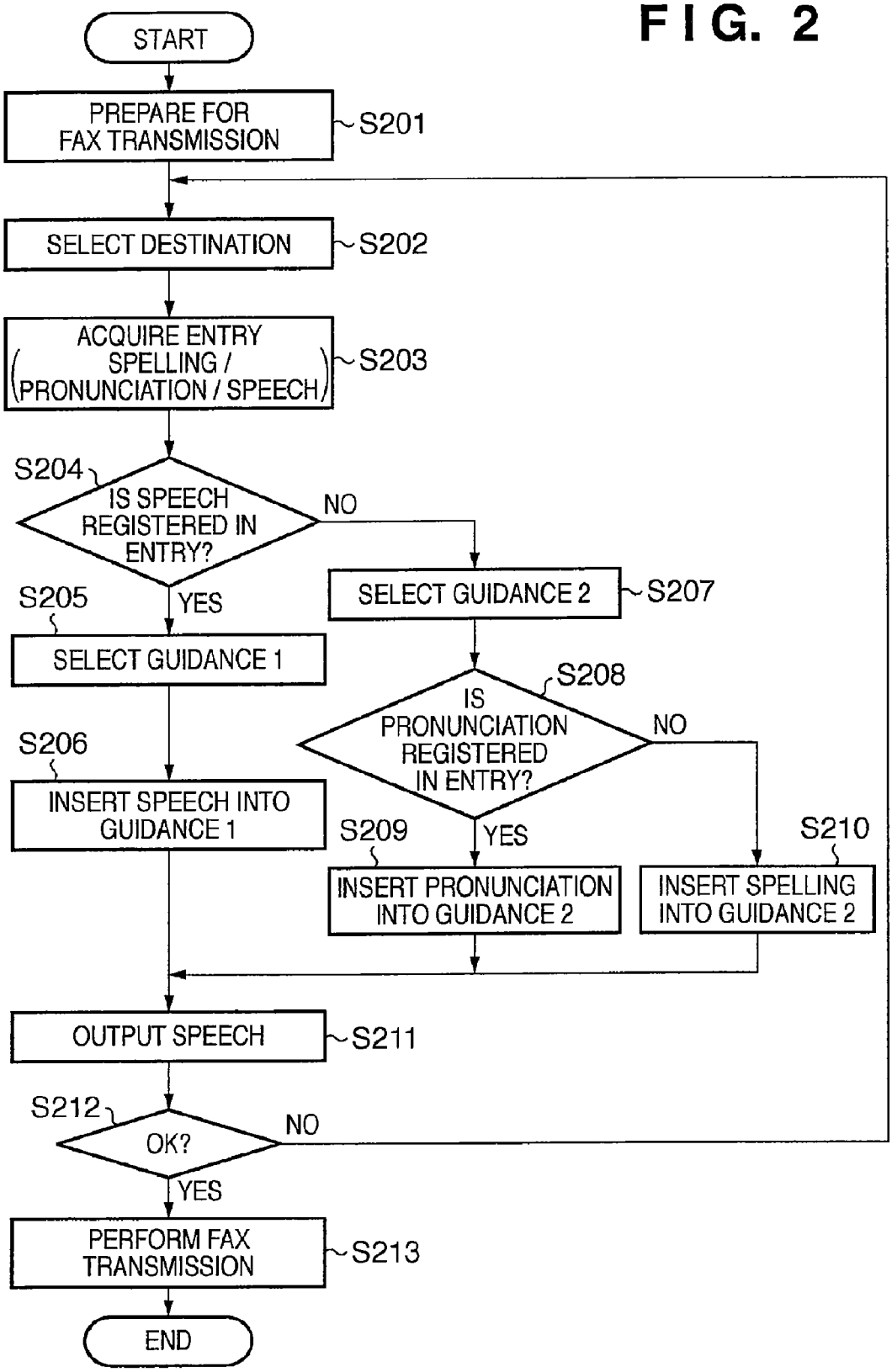
FIG. 2 is a flowchart for explaining an example of the operation of the speech processing apparatus in the embodiment.

FIG. 2 is a flowchart for explaining the operation of the speech processing apparatus according to this embodiment. A program corresponding to this flowchart is contained in, for example, speech processing programs and is executed by the CPU 201. This operation will be described by exemplifying a case in which the speech processing apparatus having the above arrangement is applied to an image forming apparatus having a FAX function. More specifically, a case in which guidance for checking the destination of FAX transmission is output will be described.

First of all, in step S201, the user prepares for FAX transmission via the operation unit 208. For example, the user selects a menu for FAX transmission and sets a document on the image forming apparatus.

In step S202, the user opens the address book and selects a desired destination. FIG. 4 shows an example of the address book.

In step S203, the entry acquisition unit 101 acquires the entry corresponding to the destination selected by the user.

In step S204, the registration information determination unit 102 determines whether any speech is registered in the entry acquired in step S203. For example, in the address book in FIG. 4, although speech is registered in the entry corresponding to "Sato", no speech is registered in the entry corresponding to "Tanaka". If speech is registered in the entry, the process advances to step S205. If no speech is registered, the process advances to step S207.

In step S205, the guidance selection unit 103 selects guidance 1 from the guidance holding unit 107. Note that the guidance to be output is guidance for checking the destination of FAX transmission. Referring to FIG. 5, this guidance is the one with ID "1". Therefore, the selected guidance is "START SENDING TO <$name> BY FAX.".

In step S206, the guidance generating unit 104 inserts, as a tag, the information of the entry acquired in step S203 in the variable portion of guidance 1 selected in step S205. A speech index is registered in the tag.

Assume that the entry acquired in step S203 corresponds to "Sato" in FIG. 4. In this case, the guidance which is generated is "START SENDING TO <SPEECH=w2001;> BY FAX.". In this case, the portion <SPEECH=w2001;> is a tag. Assume that a tag is enclosed by "< >", and information is registered in the form of "item name=value;".

In step S207, the guidance selection unit 103 selects guidance 2 from the guidance holding unit 107. As in step S205, the guidance with ID "1" in FIG. 5 is selected. The selected guidance is therefore "START SENDING BY FAX. DESTINATION IS, <$fname>.".

In step S208, the registration information determination unit 102 determines whether any pronunciation is registered in the entry acquired in step S203. For example, in the address book in FIG. 4, a pronunciation is registered in the entry corresponding to "Tanaka", but no pronunciation is registered in the entry corresponding to "Suzuki". If a pronunciation is registered in the entry, the process advances to step S209. If no pronunciation is registered, the process advances to step S210.

In step S209, the guidance generating unit 104 inserts, as a tag, the information of the entry acquired in step S203 in the variable portion of guidance 2 selected in step S207. A pronunciation is registered in the tag. Assume that the entry acquired in step S203 corresponds to "Tanaka" in FIG. 4. In this case, the generated guidance is "START SENDING BY FAX. DESTINATION IS, <PRONUNCIATION=TANAKA;>.".

In step S210, the guidance generating unit 104 inserts, as a tag, the information of the entry acquired in step S203 in the variable portion of guidance 2 selected in step S207. A spelling is registered in the tag. Assume that the entry acquired in step S203 corresponds to "Suzuki" in FIG. 4. In this case, the generated guidance is "START SENDING BY FAX. DESTINATION IS, <SPELLING=SUZUKI;>.".

In step S211, the speech synthesis unit 105 outputs the guidance generated in step S206, S209, or S210 by speech.

In step S212, the user listens to the speech guidance output in step S211 and determines whether the destination of FAX transmission is correct. If YES in step S212, the process advances to step S213. If NO in step S212, the process returns to step S202 to select another destination.

In step S213, the image forming apparatus performs FAX transmission and terminates the processing.

Figure 3:
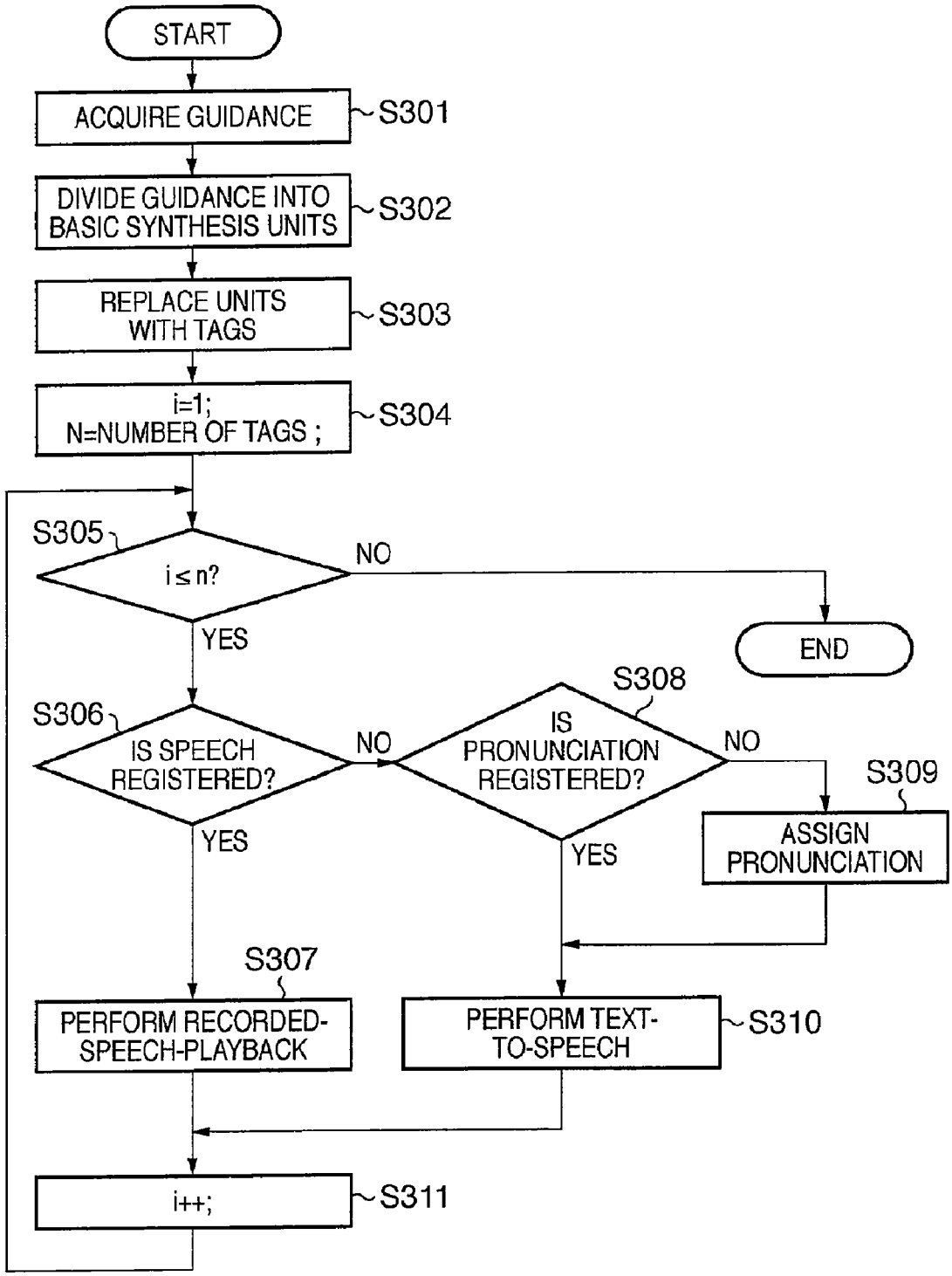
FIG. 3 is a flowchart for explaining a sequence of processing in a speech synthesis unit in the embodiment.

FIG. 3 is a flowchart for explaining a sequence of processing in the speech synthesis unit 105 in this embodiment.

In step S301, the speech synthesis unit 105 acquires a guidance to be output by speech. This guidance is the one generated by the guidance generating unit 104 in step S206, S209, or S210.

In step S302, the speech synthesis unit 105 divides the guidance into basic synthesis units using the basic synthesis unit dictionary 108. Assume that a tag initially inserted in the guidance is a basic synthesis unit. For this division, it is possible to use a known morphological analysis technique. For example, the speech synthesis unit 105 divides the guidance by matching spellings in the basic synthesis unit dictionary and the guidance in accordance with the left longest matching principle.

FIG. 8 shows the result obtained by dividing the guidance "START SENDING BY FAX. DESTINATION IS, <PRONUNCIATION=TANAKA;>." using the basic synthesis unit dictionary in FIG. 6. The guidance is divided into seven basic synthesis units. The tag <PRONUNCIATION=TANAKA;> initially inserted in the guidance is a basic synthesis unit.

In step S303, the speech synthesis unit 105 replaces the divided basic synthesis units with tags. Spellings and speech indexes are registered in the tags. In addition, any tag initially inserted in the guidance remains unchanged. For example, the basic synthesis unit "START SENDING" is replaced with the tag <SPELLING=START SENDING; SPEECH=w1001;>. FIG. 9 shows the result obtained by replacing the basic synthesis units with tags.

In step S304, a variable i is set to 1. In addition, a variable n is set to the number of tags. Referring to FIG. 9, the number of tags is seven.

In step S305, the speech synthesis unit 105 determines whether i is equal to or less than n. If i is equal to or less than n, the process advances to step S306. If i is larger than n, the processing is terminated.

In step S306, the speech synthesis unit 105 determines whether a speech index is registered in the ith tag. If YES in step S306, the process advances to step S307. If NO in step S306, the process advances to step S308. Referring to FIG. 9, no speech index is registered in the sixth tag, but speech indexes are registered in the remaining tags.

In step S307, the speech synthesis unit 105 extracts speech using the speech index registered in the ith tag. The speech synthesis unit 105 plays back the extracted speech. This speech synthesis is recorded-speech-playback (first speech synthesis).

In step S308, the speech synthesis unit 105 determines whether any pronunciation is registered in the ith tag. If YES in step S308, the process advances to step S310. If NO in step S308, the process advances to step S309.

In step S309, the speech synthesis unit 105 assigns a pronunciation to the ith tag. First of all, the speech synthesis unit 105 extracts the spelling registered in the ith tag. The speech synthesis unit 105 then estimates the pronunciation of the extracted spelling. For this processing, it is possible to use a known technique of assigning pronunciations to unknown words. Finally, the speech synthesis unit 105 registers the estimated pronunciation in the ith tag. Assume that the speech synthesis unit 105 has estimated the pronunciation "suzuki" from the spelling "Suzuki" of the tag <SPELLING=SUZUKI;>. In this case, the tag is <SPELLING=SUZUKI; PRONUNCIATION=SUZUKI;>. However, the technique of assigning pronunciations to unknown words may contain errors. For example, it is possible to estimate the wrong pronunciation "rinboku" from the spelling "Suzuki". Wrong pronunciations are often estimated when we use KANJI instead of alphabet for spelling.

In step S310, the speech synthesis unit 105 extracts the pronunciation registered in the ith tag. The speech synthesis unit 105 then performs speech synthesis from the extracted pronunciation using text-to-speech (second speech synthesis).

In step S311, the value of the variable i is increased by one. The process then returns to step S305.

As described above, if an entry in which no speech is registered is acquired, guidance 2 is selected. The fixed portions are then output using recorded-speech-playback, and the variable portion is output using text-to-speech. Note that guidance 2 has the variable portion located at the end of the guidance. This makes it possible to separately output the portion based on recorded-speech-playback and the portion based on text-to-speech. Playing back an entry (a word or phrase) in which no speech is registered according to guidance 2 (second grammar) may reduce the number of times of changing a word or phrase played back by recorded-speech-playback and a word or phrase played back by text-to-speech more than playing back the entry according to guidance 1 (first grammar). That is, according to an effect of this embodiment, the above number of times of changing can be reduced. With the above operation, it is possible to reduce difficulty in hearing of a guidance due to the difference in quality between the output sound based on recorded-speech-playback and the output sound based on text-to-speech.

According to the grammar of guidance 2 described above, a word which explains a variable portion exists before the variable portion. The user can easily estimate the content of the variable portion (the type of information) by hearing the word explaining this variable portion in advance. This makes it easier to hear the variable portion output by text-to-speech.

Note that accent information can be attached to the pronunciation registered in an entry. In this case, in step S309, the speech synthesis unit 105 estimates the pronunciation with the accent information. In step S310, the input based on text-to-speech is the pronunciation with the accent information.

In step S310, the speech synthesis unit 105 may divide the pronunciation into low-level synthesis units and playback the pieces of speech on a low-level synthesis unit basis. For example, the result obtained by dividing the pronunciation "suzuki" is <MORA=SU; SPEECH=w0165;>, <MORA=ZU; SPEECH=w0160;>, and <MORA=KI; SPEECH=w0210;>. This result is output by recorded-speech-playback in step S307. Note, however, that the speech quality of this output deteriorates as compared with a case in which speech is registered for "Suzuki".

In addition, short ancillary words such as "Mr" can be attached to the variable portion of guidance 2. More specifically, for example, the above guidance can be expressed as "START SENDING BY FAX. DESTINATION IS, MR<$name>.". That is, a variable portion is placed at the last clause, phrase, or word of a guidance.

The above embodiment has exemplified the case in which the speech processing apparatus of the present invention is applied to the image forming apparatus having the FAX function. However, the present invention is not limited to this. Obviously, the present invention can be applied to any information processing apparatus having a speech synthesis function in the same manner as described above.

The speech processing apparatus described above is a speech processing apparatus which can playback a sentence comprising a plurality of words or phrases using recorded-speech-playback or text-to-speech, which performs the following processing. First of all, this apparatus specifies whether each of a plurality of words or phrases constituting a sentence to be played back is a word or phrase to be played back by recorded-speech-playback or text-to-speech. When playing back each of the plurality of words or phrases according to the first sequence using the specified synthesis method, the apparatus selects, based on the number of times of changing/reversing playback using recorded-speech-playback and playback using text-to-speech, whether to playback each of the plurality of words or phrases according to the first sequence (the first grammar) or a sequence different from the first sequence (a grammar different from the first grammar). In the above processing, when synonymous sentences are to be expressed by different grammars, the main object is not to match all the words.

The above speech processing apparatus is characterized by reducing the perceptual hearing difficulty due to frequent changing of playback using recorded-speech-playback and playback using text-to-speech. For this purpose, different grammars are used (in other words, different sequences of words or phrases constituting a sentence are used).

For the sake of easy understanding, the simple case has been described, which uses a short sentence with which the number of times of changing (reversing) playback using recorded-speech-playback and playback using text-to-speech is two at most. In this case, when the number of times of changing playback using recorded-speech-playback and playback using text-to-speech is two (when recorded-speech-playback changes to text-to-speech, and text-to-speech changes to recorded-speech-playback), simple control is performed to reduce the number of times of changing to one.

For a long sentence with which the maximum number of times of changing (reversing) playback using recorded-speech-playback and playback using text-to-speech exceeds two, a satisfactory effect cannot be obtained by changing two types of pieces of guidance in the above manner.

When such long sentences are to be processed, it is effective to select guidance 1 (the first grammar (the first sequence)) and other pieces of guidance (one or more grammars (the second sequence) different from the first grammar) based on whether the number of times of changing exceeds an allowable range.

The following description will additionally explain that the above speech processing apparatus can also cope with long sentences.

A case in which one guidance contains two variable portions (portions to which recorded-speech-playback and text-to-speech are selectively applied) will be described below with reference to FIGS. 10 and 11.

FIG. 11 shows an example of pieces of guidance held by the guidance holding unit 107. Assume that the relationship in "ease of hearing in terms of sentence syntax (word sequence)" between pieces of guidance 1 to 4 is represented by guidance 1> guidance 2=guidance 3> guidance 4. If all the words of a sentence are played back by the recorded-speech-playback scheme, the speech played back using guidance 1 is easiest to hear, and the speech played back using guidance 4 is hardest to hear. The ease of hearing speech using guidance 2 is equal to that using guidance 3. The portions <$title> and <$name> in each guidance are variable portions. Guidance 1 to 4 with ID "1" are used to check a destination and the title of a document upon scanning on the document and selection of the function of transmitting it by E-mail.

FIG. 10 is a flowchart for explaining the operation of the speech processing apparatus in this embodiment.

First of all, in step S1001, the user prepares for E-mail transmission via the operation unit 208. For example, the user selects a menu for E-mail transmission and sets a document on the image forming apparatus.

In step S1002, the user opens the address book and selects a desired destination. This processing is the same as that in step S202.

In step S1003, the entry acquisition unit 101 acquires the entry corresponding to the destination selected by the user. This processing is the same as that in step S203.

In step S1004, the apparatus acquires the title of the document set by the user. For example, the scanner unit 205 reads the document and OCRs the result, thereby acquiring the title.

In step S1005, the apparatus divides guidance 1 into basic synthesis units and converts them into tags. The apparatus converts the entry acquired in step S1003 into a tag and inserts it into <$name> of guidance 1. Assume that "Sato" in FIG. 4 is acquired. The apparatus inserts the title acquired in step S1004 into <$title> of guidance 1. Assume that "weekly report" is acquired. According to the above case, guidance 1 is "SCAN To SEND WEEKLY REPORT TO <SPEECH=w2001;> BY E-MAIL.".

Division into basic synthesis units is the same processing as that in step S302. If, however, guidance 1 contains a character string which is not contained in the basic synthesis unit dictionary 108, the tag <SPELLING=;> is used. If, for example, "weekly report is" is not contained in the basic synthesis unit dictionary 108, <SPELLING=WEEKLY REPORT;> is set. Conversion into tags is the same processing as that in step S303. FIG. 12 shows an example of the result obtained by converting the guidance into tags. As the basic synthesis unit dictionary 108, the one shown in FIG. 6 is used.

In step S1006, the apparatus calculates the number of times of changing (the number of times of reversing) playback using recorded-speech-playback and playback using text-to-speech when the speech synthesis unit 105 outputs guidance 1 by speech. This number of times is equivalent to the sum of the number of times of changing from playback using recorded-speech-playback to playback using text-to-speech and the number of times of changing from playback using text-to-speech to playback using recorded-speech-playback. If a speech index is registered in a tag, recorded-speech-playback is used. If no speech index is registered in a tag, text-to-speech is used.

This processing will be described concretely using the case shown in FIG. 12. Since no speech index is registered in the tag with ID "2", text-to-speech is used for it. Speech indexes are registered in the remaining tags, recorded-speech-playback is used for them. Recorded-speech-playback changes to text-to-speech before the tag with ID "2". Text-to-speech changes to recorded-speech-playback after the tag with ID "2". The number of times of changing is therefore two.

In step S1007, the apparatus determines whether the number of times of changing recorded-speech-playback and text-to-speech is smaller than a predetermined number (N). N is a predetermined constant. If this number of times is less than the predetermined number (YES), the process advances to step S1015. If the number of times is equal to or larger than the predetermined number (NO), the process advances to step S1008. For example, N=2. In the case in FIG. 12, the process advances to step S1008.

The processing from step S1008 to step S1010 is the same as that from step S1005 to step S1007 except that guidance 2 is used instead of guidance 1.

The processing from step S1011 to step S1013 is the same as that from step S1005 to step S1007 except that guidance 3 is used instead of guidance 1.

The processing in step S1014 is the same as that in step S1005 except that guidance 4 is used instead of guidance 1.

In step S1015, the apparatus outputs speech based on the tags which have replaced the respective units in step S1005, S1008, S1011, or S1014. Concrete processing is the same as the processing from step S304 to step S311 in FIG. 3.

The processing in step S1008 and the subsequent steps will be described by exemplifying the case in which the apparatus has acquired "Sato" as an entry in step S1003, and has acquired "weekly report" as a title in step S1004.

In step S1008, guidance 2 becomes "SCAN TO SEND WEEKLY REPORT BY E-MAIL. DESTINATION IS, <SPEECH=w2001;>.". FIG. 13 shows an example of the result obtained by converting the respective units into tags. Recorded-speech-playback changes to text-to-speech before and after the tag with ID "2", and the number of times of changing is two. Since the apparatus determines in step S1010 that the number of times of changing (2) is not smaller than N (2) (NO), the process advances to step S1011.

In step S1011, guidance 2 becomes "SCAN TO SEND <SPEECH=w2001;> BY E-MAIL. TITLE IS, WEEKLY REPORT.". FIG. 14 shows an example of the result obtained by converting the respective units into tags. Recorded-speech-playback and text-to-speech change before and after the tag with ID "8". The tag with ID "9" is silence of 400 ms, and there is no subsequent tag. That is, there is no speech after the tag with ID "8". Assume that if there is no subsequent speech, the number of times of changing is not counted. That is, in this case, the number of times of changing is one. Since the apparatus determines in step S1013 that the number of times of changing is smaller than two (YES), the process advances to step S1015. In step S1015, the apparatus outputs guidance 3 by speech.

N=2 indicates, for example, that "User cannot allow two or more times of changing". In the steps in FIG. 10, the apparatus keeps performing determination on guidance 1 to guidance 3 each having a natural sentence syntax (word sequence) in the order named until a guidance with which the number of times of changing is not equal to or more than two. If the apparatus cannot find a guidance with which the number of times of changing is less than a desired number in any determination step (S1007, S1010, and S1013), the apparatus finally selects guidance 4. Guidance 4 has a silence portion placed at the end of each variable portion so as to have the property of "minimizing the number of times of changing (the number of times of reversing) when, for example, both <$name> and <$title> are played back by text-to-speech".

According to the above embodiment, it is possible to provide the user with a guidance which is easiest to hear in terms of sentence syntax (word sequence) and can be played back within the allowable range of the number of times of changing (the number of times of reversing) set by the user.

Other Embodiments

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention can be implemented by a computer, the program code installed in the computer also implements the present invention. In other words, the present invention also covers a computer program for the purpose of implementing the functions of the present invention.

In this case, so long as the system or apparatus has the functions of the program, the program may be executed in any form, such as an object code, a program executed by an interpreter, or script data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-182555, filed Jul. 11, 2007, and No. 2008-134655, filed May 22, 2008, which are hereby incorporated by reference herein in their entirety.

The invention claimed is:

1. A speech processing apparatus which generates guidance speech corresponding to user operation using a speech synthesis unit configured to perform speech synthesis while selectively changing recorded-speech-playback and text-to-speech, the apparatus comprising:

a guidance holding unit that holds (i) a first guidance including fixed portions indicating fixed messages, and a first variable portion, and a second variable portion, wherein the first variable portion and the second variable portion are located between the fixed portions and indicate that a first message and a second message corresponding to user operation are inserted, (ii) a second guidance that has the second variable portion located at the end of a fixed portion and is synonymous with the first guidance, and (iii) a third guidance which has the first variable portion located at the end of a fixed portion and is synonymous with the first guidance;

an entry holding unit that holds a set of entries in which spellings, pronunciations of the spellings, and pieces of speech based on the pronunciations which are associated with user operation are configured to be registered; and an acquisition unit that acquires an entry corresponding to operation performed by a user from said entry holding unit, wherein, based on a number of times of changing between the recorded-speech-playback and the text-to-speech when performing speech synthesis, said speech synthesizer unit applies:

the first guidance if the number of times of changing when performing speech synthesis using the first guidance is less than a predetermined number, the second guidance if the number of times of changing when performing speech synthesis using the first guidance is not less than the predetermined number, and if the number of times of changing when performing speech synthesis using the second guidance is less than the predetermined number, and the third guidance if the number of times of changing when performing speech synthesis using the first guidance is not less than the predetermined number, and if the number of times of changing when performing speech synthesis using the second guidance is not less than the predetermined number, and if the number of times of changing when performing speech synthesis using the third guidance is less than the predetermined number.

2. The apparatus according to claim 1, further comprising:

a communication unit configured to perform network communication, wherein the user operation includes an operation associated with network communication, and wherein said entry holding unit comprises an address book for network communication.

3. A speech processing method of generating guidance speech corresponding to user operation by controlling a speech processing apparatus having a guidance holding unit that holds (i) a first guidance including fixed portions indicating fixed messages, and a first variable portion, and a second variable portion, wherein the first variable portion and the second variable portion are located between the fixed portions and indicate that a first message and a second message corresponding to user operation are inserted, (ii) a second guidance that has the second variable portion located at the end of a fixed portion and is synonymous with the first guidance, and (iii) a third guidance which has the first variable portion located at the end of a fixed portion and is synonymous with the first guidance;

an entry holding unit that holds a set of entries in which spellings, pronunciations of the spellings, and pieces of speech based on the pronunciations which are associated with user operation are configured to be registered, and a speech synthesis unit that performs speech synthesis while selectively changing recorded-speech-playback and text-to-speech, the method comprising the steps of:

acquiring an entry corresponding to an operation performed by a user from the entry holding unit; and applying, based on a number of times of changing between the recorded-speech-playback and the text-to-speech when performing speech synthesis:

the first guidance if the number of times of changing when performing speech synthesis using the first guidance is less than a predetermined number, the second guidance if the number of times of changing when performing speech synthesis using the first guidance is not less than the predetermined number, and if the number of times of changing when performing speech synthesis using the second guidance is less than the predetermined number, and the third guidance if the number of times of changing when performing speech synthesis using the first guidance is not less than the predetermined number, and if the number of times of changing when performing speech synthesis using the second guidance is not less than the predetermined number, and if the number of times of changing when performing speech synthesis using the third guidance is less than the predetermined number.

4. A non-transitory computer-readable storage medium having stored thereon a computer program that causes a computer to execute a speech processing method defined in claim 3.

* * * * *